US006443823B1

(12) United States Patent
Tolles et al.

(10) Patent No.: US 6,443,823 B1
(45) Date of Patent: Sep. 3, 2002

(54) CARRIER HEAD WITH LAYER OF CONFORMABLE MATERIAL FOR A CHEMICAL MECHANICAL POLISHING SYSTEM

(75) Inventors: Robert D. Tolles, Santa Clara; Tsungan Cheng, Saratoga; John Prince, Los Altos, all of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/478,123

(22) Filed: Jan. 5, 2000

Related U.S. Application Data

(63) Continuation of application No. 08/728,688, filed on Oct. 10, 1996.

(51) Int. Cl.[7] ..... B24B 7/22
(52) U.S. Cl. ..... 451/288; 451/388
(58) Field of Search ..... 451/288, 287, 451/388, 398, 289, 290, 41

(56) References Cited

U.S. PATENT DOCUMENTS

| | | | | | |
|---|---|---|---|---|---|
| 4,132,037 | A | * | 1/1979 | Bonora | 451/390 |
| 4,270,316 | A | | 6/1981 | Kramer et al. | 51/283 |
| 4,373,991 | A | | 2/1983 | Banks | 156/645 |
| 4,519,168 | A | | 5/1985 | Cesna | 51/216 |
| 4,669,226 | A | | 6/1987 | Mandler | 51/216 |
| 4,918,869 | A | | 4/1990 | Kitta | 51/131 |
| 4,954,142 | A | | 9/1990 | Carr et al. | 51/309 |
| 5,081,795 | A | | 1/1992 | Tamaka et al. | 51/131 |
| 5,193,316 | A | | 3/1993 | Olmstead | 51/281 |
| 5,205,082 | A | | 4/1993 | Shendon et al. | 51/283 |
| 5,230,184 | A | | 7/1993 | Bukhman | 51/283 |
| 5,255,474 | A | | 10/1993 | Gawa et al. | 51/131 |
| 5,423,558 | A | | 6/1995 | Koeth et al. | 279/3 |
| 5,423,716 | A | | 6/1995 | Strasbau | 451/388 |
| 5,441,444 | A | | 8/1995 | Nakajima | 451/289 |
| 5,443,416 | A | * | 8/1995 | Volodarsky et al. | 451/388 |
| 5,449,316 | A | | 9/1995 | Strasbaugh | 451/289 |
| 5,584,746 | A | * | 12/1996 | Tanaka et al. | 451/41 |
| 5,624,299 | A | * | 4/1997 | Shendon | 451/28 |
| 5,733,182 | A | * | 3/1998 | Muramatsu et al. | 451/289 |

FOREIGN PATENT DOCUMENTS

| | | |
|---|---|---|
| FR | 2 558 095 A | 7/1985 |
| JP | 61 25768 | 2/1986 |
| JP | 22 43263 | 9/1990 |

OTHER PUBLICATIONS

Holley, et al.; Mounting Method For Single–Side Polishing; IBM Technical Disclosure Bulletin, vol. 21, No. 10, Mar. 1979.*

* cited by examiner

*Primary Examiner*—Robert A. Rose
(74) *Attorney, Agent, or Firm*—Fish & Richardson

(57) ABSTRACT

A carrier head for a chemical mechanical polishing apparatus. A layer of conformable material is disposed in a recess of the carrier head to provide a mounting surface for a substrate. The conformable material may be elastic and undergo normal strain in response to an applied load. The carrier head may also include a support fixture detachably connected to a backing fixture, a retaining ring connected directly to the conformable material, and a shield ring which projects over a portion of the layer of conformable material.

4 Claims, 9 Drawing Sheets

CARRIER HEAD WITH LAYER OF CONFORMABLE MATERIAL FOR A CHEMICAL MECHANICAL POLISHING SYSTEM

This is a continuation application of U.S. application Ser. No. 08/728,688, filed Oct. 10, 1996.

BACKGROUND OF THE INVENTION

The present invention relates generally to chemical mechanical polishing of substrates, and more particularly to a carrier head for a chemical mechanical polishing system.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly more non-planar. This non-planar outer surface presents a problem for the integrated circuit manufacturer. If the outer surface of the substrate is non-planar, then a photoresist layer placed thereon is also non-planar. A photoresist layer is typically patterned by a photolithographic apparatus that focuses a light image onto the photoresist. If the outer surface of the substrate is sufficiently non-planar, then the maximum height difference between the peaks and valleys of the outer surface may exceed the depth of focus of the imaging apparatus, and it will be impossible to properly focus the light image onto the outer substrate surface.

It may be prohibitively expensive to design new photolithographic devices having an improved depth of focus. In addition, as the feature size used in integrated circuits becomes smaller, shorter wavelengths of light must be used, resulting in further reduction of the available depth of focus. Therefore, there is a need to periodically planarize the substrate surface to provide a substantially planar layer surface.

Chemical mechanical polishing (CMP) is one accepted method of planarization. This planarization method typically requires that the substrate be mounted to a carrier or polishing head. The exposed surface of the substrate is then placed against a rotating polishing pad. The carrier provides a controllable load, i.e., pressure, on the substrate to push it against the polishing pad. In addition, the carrier may rotate to provide additional motion between the substrate and polishing pad. A polishing slurry, including an abrasive and at least one chemically-reactive agent, is distributed over the polishing pad to provide an abrasive chemical solution at the interface between the pad and substrate. A CMP process is fairly complex, and differs from simple wet sanding. In a CMP process the reactive agent in the slurry reacts with the outer surface of the substrate to form reactive sites. The interaction of the polishing pad and abrasive particles with the reactive sites results in polishing.

An effective CMP process has a high polishing rate and generates a substrate surface which is finished (lacks small-scale roughness) and flat (lacks large-scale topography). The polishing rate, finish and flatness are determined by the pad and slurry combination, the relative speed between the substrate and pad, and the force pressing the substrate against the pad. Because inadequate flatness and finish can create defective substrates, the selection of a polishing pad and slurry combination is usually dictated by the required finish and flatness. Given these constraints, the polishing rate sets the maximum throughput of the polishing apparatus.

The polishing rate depends upon the force pressing the substrate against the pad. Specifically, the greater this force, the higher the polishing rate. If the carrier head applies a non-uniform load, i.e., if the carrier applies more force to one region of the substrate than to another, then the high pressure regions will be polished faster than the lower pressure regions. Therefore, a non-uniform load may result in non-uniform polishing of the substrate.

An additional consideration in the production of integrated circuits is process and product stability. To achieve a high yield, i.e., a low defect rate, each successive substrate should be polished under substantially similar conditions. Each substrate should be polished by approximately the same amount so that each integrated circuit is substantially identical.

In view of the foregoing, there is a need for a chemical mechanical polishing apparatus which optimizes polishing throughput, while providing the desired flatness and finish. Specifically, the chemical mechanical polishing apparatus should have a carrier head which applies a substantially uniform load to the substrate.

SUMMARY OF THE INVENTION

In one aspect, the invention is directed to an apparatus for use with a carrier head of a chemical mechanical polishing apparatus. A module has a recess, and a layer of conformable material is disposed in the recess to provide a mounting surface for a substrate. The module is detachably connected to the carrier head.

Implementations of the invention may include the following. The carrier head may have a backing fixture, and a loading mechanism may connect the backing fixture to the housing. The module may be mechanically or magnetically connected to the carrier head. The module may have a rim surrounding the recess, and the conformable material may be flush with the rim.

In another aspect, the invention is directed to a carrier head for positioning a substrate on a polishing surface in a chemical mechanical polishing apparatus. A base assembly has a recess, and a layer of conformable material is disposed in the recess to provide a mounting surface for a substrate. A retaining ring is connected to the mounting surface.

In another aspect, the carrier head has a base assembly, a layer of conformable material, and a shield ring which is connected to the base assembly and projects over a portion of the layer of conformable material.

Implementations of the invention may include the following. The retaining ring may be approximately the same thickness as the substrate. The shield ring may surround, but be thinner than, the retaining ring. An upper surface of the shield may be adjacent to the rim of the base assembly and be flush with the conformable material. The shield may be positioned to prevent the conformable material from extruding when the substrate is pressed against the polishing surface.

In another aspect, the carrier head has a base assembly, a layer of conformable material, and a chucking mechanism to attach the substrate to the mounting surface.

Implementations of the invention may include the following. The chucking mechanism may include a pump and a passageway through the layer of conformable material connecting the passageway to the mounting surface. The passageway may have a diameter such that it does not collapse if the pump applies suction to the passageway. The chucking mechanism includes an actuating mechanism, and a movable section of the base assembly may be connected to the actuating mechanism. The vertical motion of the movable section may form a pocket between a substrate and the layer of conformable material to suction the substrate to the mounting surface.

In another aspect, the invention is directed to a carrier head having a base assembly and a conformable material disposed in a recess of the base assembly. The conformable material has a durometer measurement selected to provide both elasticity and normal strain in response to an applied load.

Implementations of the invention include the following. The conformable material may have a durometer between about fifteen and twenty-five, such as about twenty-one. The conformable material may be substantially pure urethane. A sheet of non-adhesive material may be attached to the underside of the conformable material to provide the mounting surface.

Advantages of the invention include the following. The carrier head includes a conformable layer that applies a uniform load to the substrate. The conformable layer is chemically inert vis-a-vis the polishing process. The carrier head is also able to vacuum chuck the substrate to lift the substrate off the polishing pad.

Additional advantages of the invention will be set forth in the description which follows, and in part will be obvious from the description, or may be learned by practice of the invention. The advantages of the invention may be realized by means of the instrumentalities and combinations particularly pointed out in the claims.

BRIEF DESCRIPTION OF THE DRAWINGS

The accompanying drawings, which are incorporated in and constitute a part of the specification, schematically illustrate the present invention, and together with the general description given above and the detailed description given below, serve to explain the principles of the invention.

DESCRIPTION OF THE PREFERRED EMBODIMENT(s)

Figure 1:
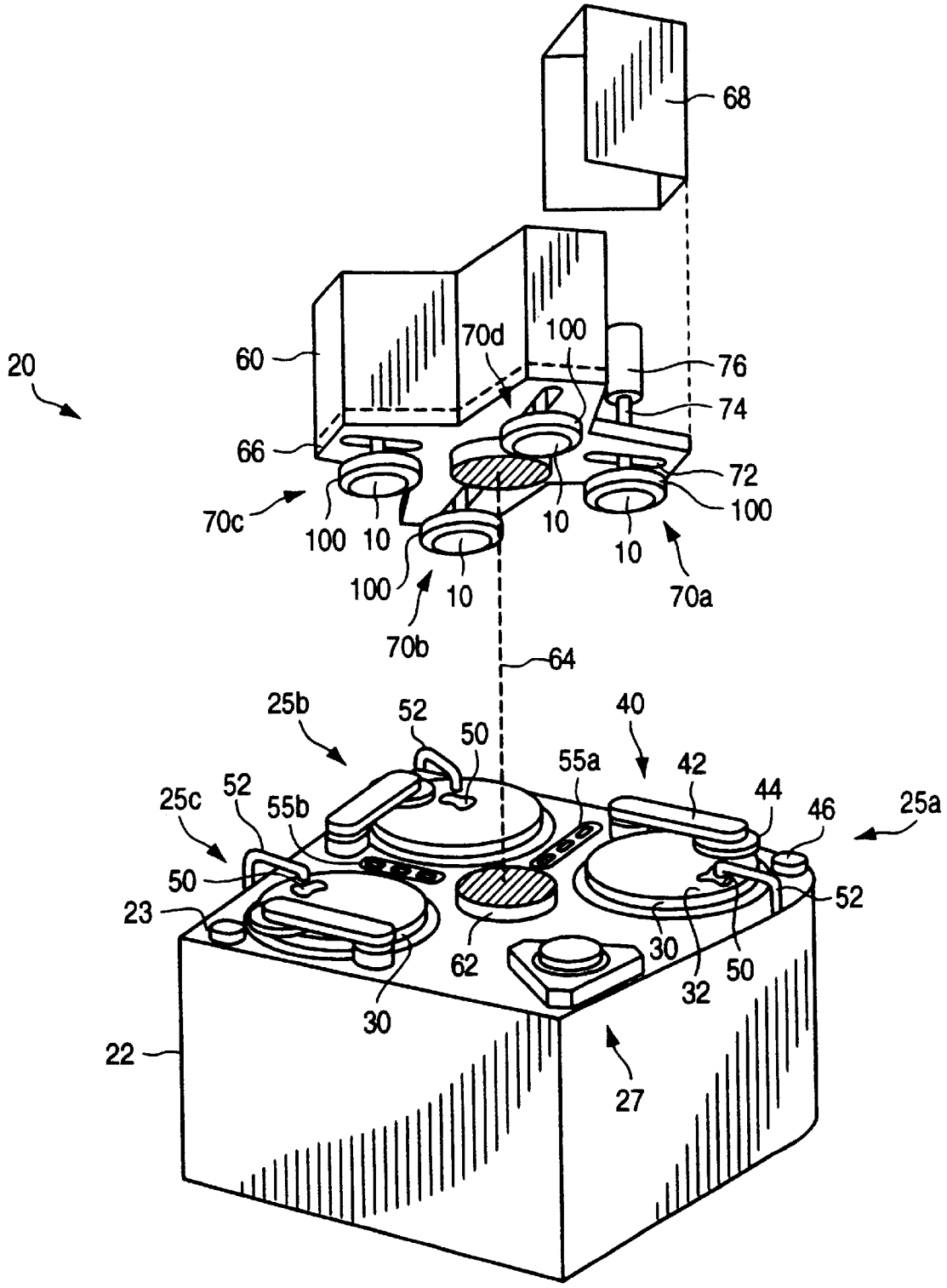
FIG. 1 is an exploded perspective view of a chemical mechanical polishing apparatus.

Referring to FIG. 1, one or more substrates 10 will be polished by a chemical mechanical polishing (CMP) apparatus 20. A complete description of CMP apparatus 20 may be found in U.S. patent application Ser. No. 08/549,336, by Perlov, et al. filed Oct. 27, 1996, entitled CAROUSEL PROCESSING SYSTEM FOR CHEMICAL MECHANICAL POLISHING, and assigned to the assignee of the present invention, the entire disclosure of which is hereby incorporated by reference.

According to the invention CMP apparatus 20 includes a lower machine base 22 with a table top 23 mounted thereon and removable upper outer cover (not shown). Table top 23 supports a series of polishing stations 25*a,* 25*b* and 25*c,* and a transfer station 27. Transfer station 27 forms a generally square arrangement with the three polishing stations 25*a,* 25*b* and 25*c*. Transfer station 27 serves multiple functions of receiving individual substrates 10 from a loading apparatus (not shown), washing the substrates, loading the substrates into carrier heads (to be described below), receiving the substrates from the carrier heads, washing the substrates again, and finally transferring the substrates back to the loading apparatus.

Each polishing station 25*a*–25*c* includes a rotatable platen 30 on which is placed a polishing pad 32. If substrate 10 is an eight-inch (200 mm) diameter disk, then platen 30 and polishing pad 32 will be about twenty inches in diameter. Platen 30 is preferably a rotatable aluminum or stainless steel plate connected by stainless steel platen drive shaft (not shown) to a platen drive motor (not shown). For most polishing processes, the drive motor rotates platen 30 at thirty to two-hundred revolutions per minute, although lower or higher rotational speeds may be used.

Figure 5:
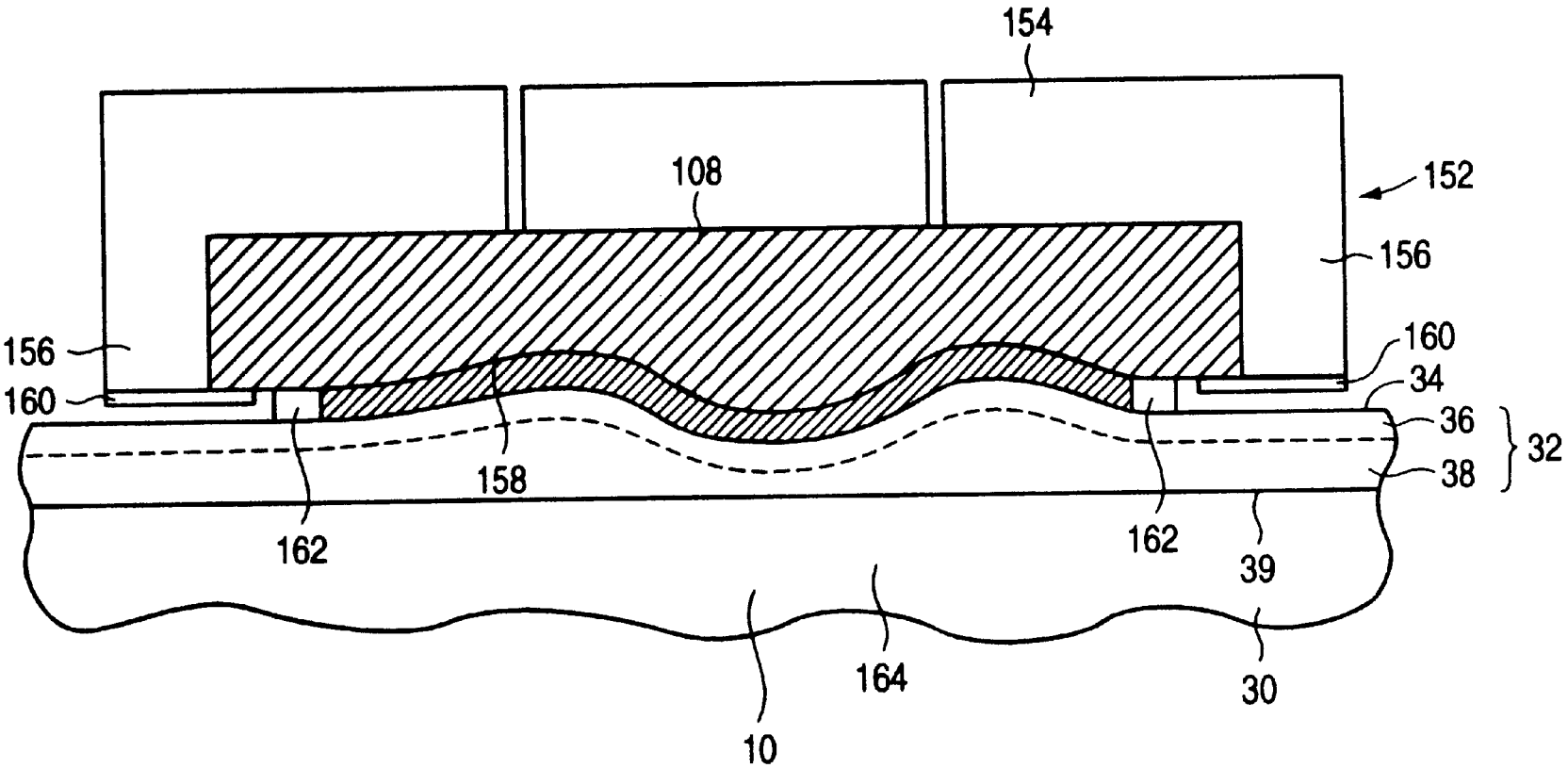
FIG. 5 is an exaggerated cross-sectional view of a substrate in contact with the layer of conformable material of the carrier head of FIG. 4A or FIG. 4B.

Referring to FIG. 5, polishing pad 32 is a composite material with a roughened polishing surface 34. Polishing pad 32 may be attached to platen 30 by a pressure-sensitive adhesive layer 39. Polishing pad 32 may have a fifty mil thick hard upper layer 36 and a fifty mil thick softer lower layer 38. Upper layer 36 is preferably a material composed of polyurethane mixed with other fillers. Lower layer 38 is preferably a material composed of compressed felt fibers leached with urethane. A common two-layer polishing pad, with the upper layer composed of IC-1000 and the lower layer composed of SUBA-4, is available from Rodel, Inc., located in Newark, Del. (IC-1000 and SUBA-4 are product names of Rodel, Inc.).

Referring again to FIG. 1, each polishing station 25*a*–25*c* may further include an associated pad conditioner apparatus 40. Each pad conditioner apparatus 40 has a rotatable arm 42 holding an independently rotating conditioner head 44 and an associated washing basin 46. The conditioner apparatus maintains the condition of the polishing pad so it will effectively polish any substrate pressed against it while it is rotating.

A slurry 50 containing a reactive agent (e.g., deionized water for oxide polishing), abrasive particles (e.g., silicon dioxide for oxide polishing) and a chemically reactive catalyzer (e.g., potassium hydroxide for oxide polishing), is supplied to the surface of polishing pad 32 by a slurry supply tube 52. Sufficient slurry is provided to cover and wet the entire polishing pad 32. Two or more intermediate washing stations 55*a* and 55*b* are positioned between neighboring polishing stations 25*a,* 25*b* and 25*c*. The washing stations rinse the substrates as they pass from one polishing station to another.

A rotatable multi-head carousel 60 is positioned above lower machine base 22. Carousel 60 is supported by a center post 62 and rotated thereon about a carousel axis 64 by a carousel motor assembly located within base 22. Center post 62 supports a carousel support plate 66. and a cover 68. Multi-head carousel 60 includes four carrier head systems 70*a,* 70*b,* 70*c,* and 70*d*. Three of the carrier head systems receive and hold substrates, and polish them by pressing them against the polishing pad 32 on platen 30 of polishing stations 25*a*–25*c*. One of the carrier head systems receives a substrate from and delivers the substrate to transfer station 27.

The four carrier head systems 70*a*–70*d* are mounted on carousel support plate 66 at equal angular intervals about carousel axis 64. Center post 62 allows the carousel motor to rotate the carousel support plate 66 and to orbit the carrier head systems 70*a*–70*d,* and the substrates attached thereto, about carousel axis 64.

Each carrier head system 70*a*–70*d* includes a polishing or carrier head 100. Each carrier head 100 independently rotates about its own axis, and independently laterally oscillates in a radial slot 72 formed in carousel support plate 66. A carrier drive shaft 74 connects a carrier head rotation motor 76 to carrier head 100 (shown by the removal of one-quarter of cover 68). There is one carrier drive shaft and motor for each head.

Figure 2:
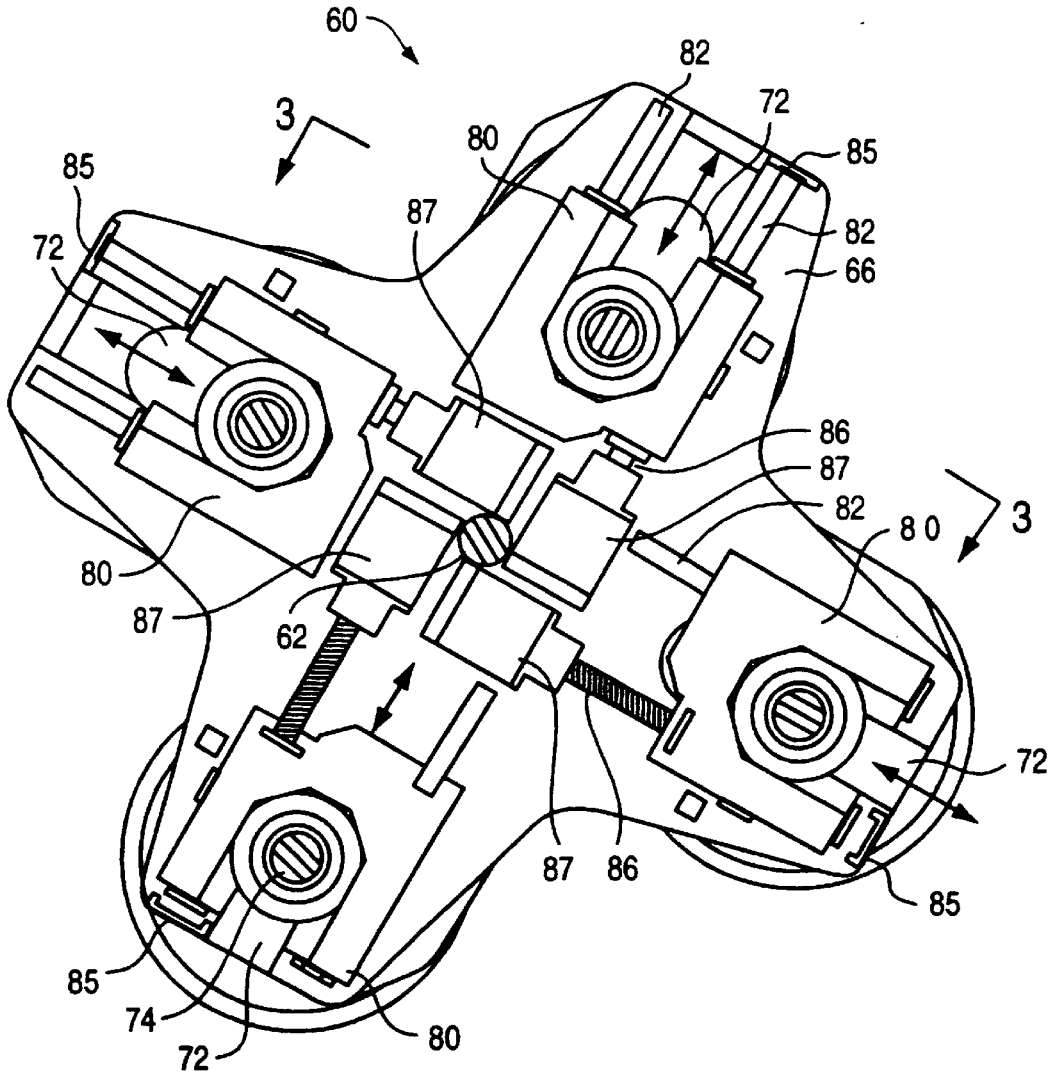
FIG. 2 is a schematic top view of a carousel, with the upper housing removed.

Referring to FIG. 2, in which cover 68 of carousel 60 has been removed, carousel support plate 66 supports the four carrier head systems 70*a*–70*d.* Carousel support plate includes four radial slots 72, generally extending radially and oriented 90° apart. Radial slots 72 may either be close-ended (as shown) or open-ended. The top of support plate supports four slotted carrier head support slides 80. Each glide 80 aligns along one of the radial slots 72 and moves freely along a radial path with respect to carousel support plate 66. Two linear bearing assemblies bracket each radial slot 72 to support each slide 80.

Figure 3:
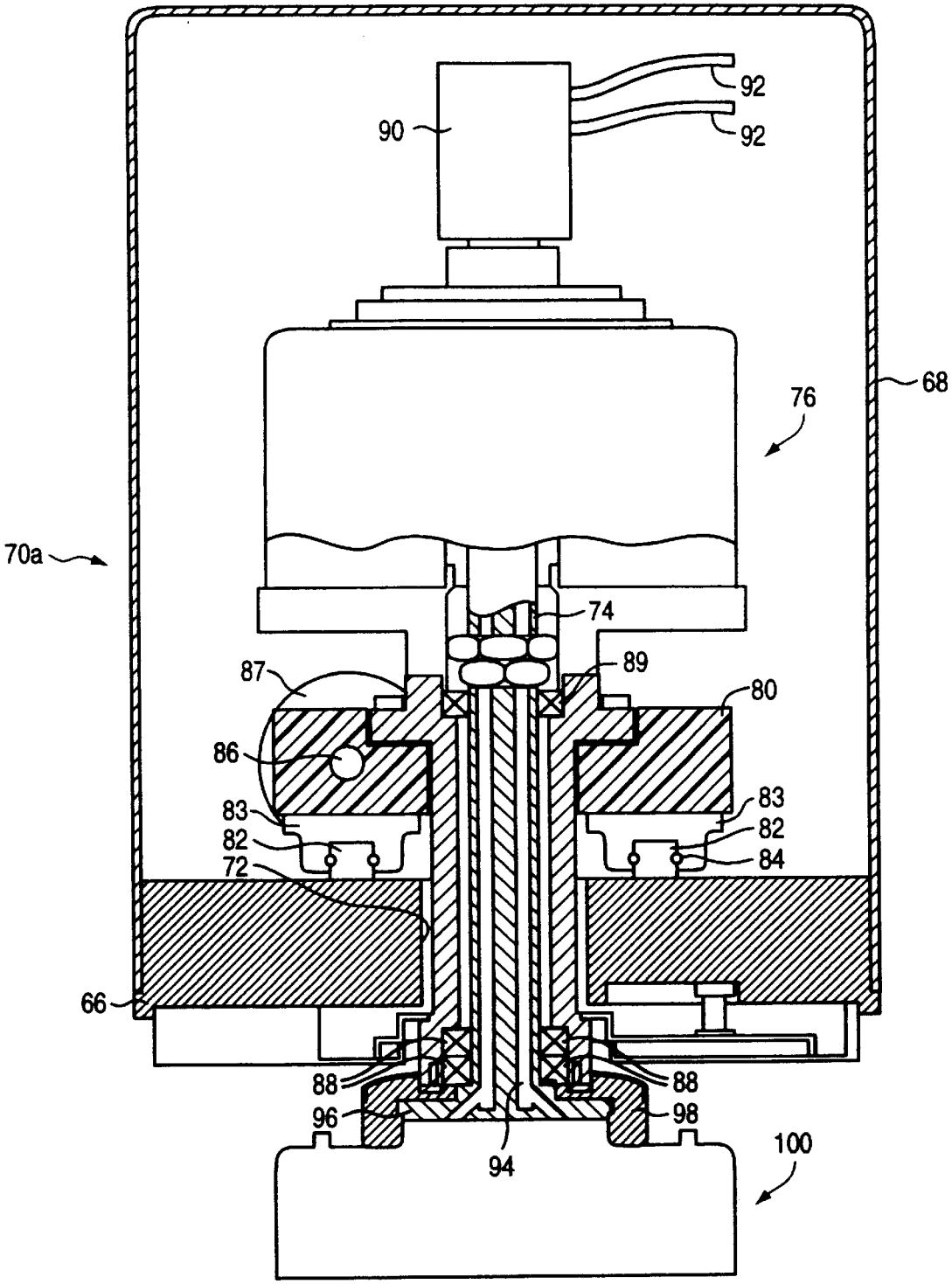
FIG. 3 is a cross-sectional view of the carousel of FIG. 2 along line 3—3.

As shown in FIGS. 2 and 3, each linear bearing assembly includes a rail 82 fixed to carousel support plate 66, and two hands 83 (only one of which is illustrated in FIG. 3) fixed to slide 80 to grasp the rail. Two bearings 84 separate each hand 83 from rail 82 to provide free and smooth movement therebetween. Thus, the linear bearing assemblies permit the slides 80 to move freely along radial slots 72.

A bearing stop 85 anchored to the outer end one of the rails 82 prevents slide 80 from accidentally coming off the end of the rails. One of the arms of each slide 80 contains an unillustrated threaded receiving cavity or nut fixed to the slide near its distal end. The threaded cavity or nut receives a worm-gear lead screw 86 driven by a slide radial oscillator motor 87 mounted on carousel support plate 66. When motor 87 turns lead screw 86, slide 80 moves radially. The four motors 87 are independently operable to independently move the four slides along the radial slots 72 in carousel support plate 66.

A carrier head assembly or system, each including a carrier head 100, a carrier drive shaft 74, a carrier motor 76, and a surrounding non-rotating shaft housing 78, is fixed to each of the four slides. Drive shaft housing 78 holds drive shaft 74 by paired sets of lower ring bearings 88 and a set of upper ring bearings 89. Each carrier head assembly can be assembled away from polishing apparatus 20, slid in its untightened state into radial slot 72 in carousel support plate 66 and between the arms of slide 80, and there tightened to grasp the slide.

A rotary coupling 90 at the top of drive motor 186 couples two or more fluid or electrical lines 92 into two or more channels 94 in drive shaft 74. Channels 94 are used, as described in more detail below, to pneumatically power carrier head 100, to vacuum-chuck the substrate to the bottom of the carrier head and to actuate a retaining ring against the polishing pad.

During actual polishing, three of the carrier heads, e.g., those of carrier head systems 70*a*–70*c,* are positioned at and above respective polishing stations 25*a*–25*c*. Carrier head 100 lowers a substrate into contact with polishing pad 32, and slurry 50 acts as the media for chemical mechanical polishing of the substrate or wafer. The carrier head 100 uniformly loads the substrate against the polishing pad.

The substrate is typically subjected to multiple polishing steps, including a main polishing step and a final polishing step. For the main polishing step, usually performed at station 25*a,* carrier head 100 applies a force of approximately four to ten pounds per square inch (psi) to substrate 10. At subsequent stations, carried head 100 may apply more or less force. For example, for a final polishing step, usually performed at station 25*c,* carrier head 100 may apply a force of about three psi. Carrier motor 76 rotates carrier head 100 at about thirty to two-hundred revolutions per minute. Platen 30 and carrier head 100 may rotate at substantially the same rate.

Generally, carrier head 100 holds the substrate against the polishing pad and evenly distributes a downward pressure across the back surface of the substrate. The carrier head also transfers torque from the drive shaft to the substrate and ensures that the substrate does not slip from beneath the carrier head during polishing.

Figure 4A:
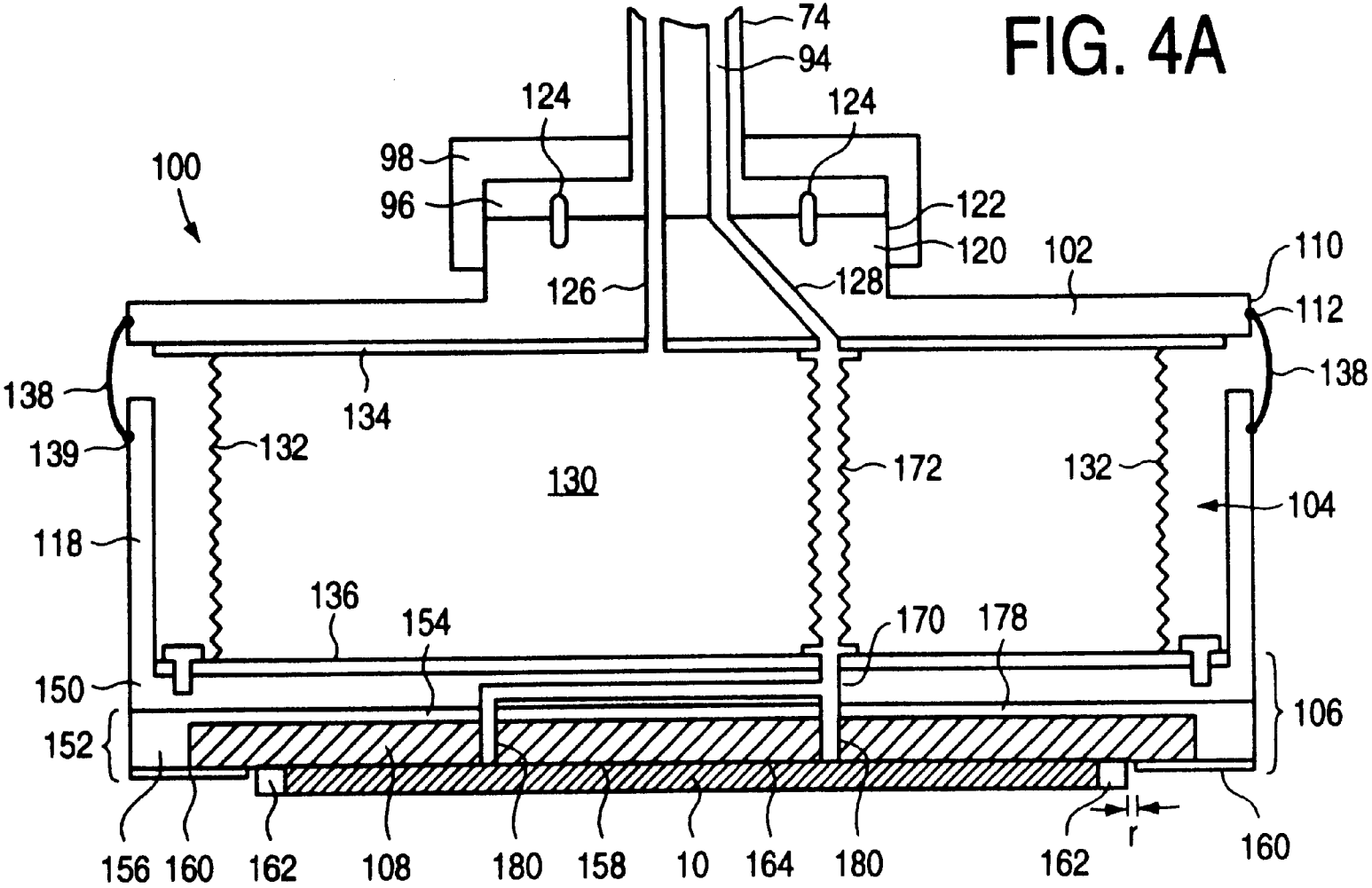
FIG. 4A is a schematic cross-sectional view of a carrier head including bellows and a layer of conformable material in accordance with the present invention.

Referring to FIG. 4A, carrier head 100 includes a housing assembly 102, a loading mechanism 104 and a base assembly 106. The drive shaft 74 is connected to housing assembly 102. Loading mechanism 104 connects housing assembly 102 to base assembly 106. The loading mechanism applied a load, i.e., a downward pressure, to base assembly 106. The base assembly 106 transfers the downward pressure from loading mechanism 104 to substrate 10 to push the substrate against the polishing pad. Base assembly 106 includes a conformable layer 108 to evenly distribute the downward pressure across the back surface of the substrate. Each of these components will be described in greater detail below.

Housing assembly 102 may be formed of aluminum or stainless steel. The housing assembly is generally circular in shape to correspond the circular configuration of the substrate to be polished. The top surface of the housing assembly may include a cylindrical hub 120 having a threaded neck 122. To connect drive shaft 74 to carrier head 100, two dowel pins 124 may be inserted into matching dowel pin holes in hub 120 and a flange 96. Then, a threaded perimeter nut 98 is screwed onto threaded neck 122 to firmly attach carrier head 100 to drive shaft 74. When drive shaft 74 rotates, dowel pins 124 transfer torque to housing assembly 102 to rotate the carrier head about the same axis as the drive shaft.

At least two conduits 126 and 128 extend through hub 120. There may be one conduit for each channel 94 in drive shaft 74. When carrier head 100 is attached to drive shaft 74, the dowel pins align the carrier head so that conduits 126 and 128 connect to channels 94. O-rings (not shown) may be positioned in hub 120 surrounding each conduit 126 and 128 to form a fluid-tight seal between the conduits to the channels.

Loading mechanism 104 forms a vertically-movable seal between housing assembly 102 and base assembly 106 and defines a pressure chamber 130. A gas, such as air, is pumped into and out of pressure chamber 130 through conduit 126 to control the load applied to base assembly 106. When air is pumped into pressure chamber 130, base assembly 106 is forced downwardly to bring substrate 10 into contact with polishing pad 32. When air is pumped out of pressure chamber 130, base assembly is lifted upwardly to remove the substrate from polishing pad 32.

Loading mechanism 104 may include a cylindrical bellows 132 which is bolted or fixed to housing assembly 102 and base assembly 106 to form pressure chamber 130. Bellows 132 may be a stainless steel cylinder which expands or contracts depending upon whether a gas is supplied to or removed from pressure chamber 130. Bellows 132 may include upper and lower support plates 134 and 136 which are bolted or otherwise secured to housing assembly 102 and a base assembly 106, respectively. A cylindrical seal 138 may fit into a circumferential groove 112 on rim 110 of housing 102 and in a circumferential groove 139 in an upwardly-extending wall portion 118. of, base assembly 106. The seal 138 surrounds and protects bellows 132 from the corrosive effects of slurry 50. When housing assembly 102 is rotated, bellows 132 transfers torque from the housing assembly to the base assembly, causing it to also rotate. However, because the bellows are flexible, base assembly 106 can pivot with respect to the housing assembly about an axis parallel to the surface of the polishing pad to remain substantially parallel to the polishing pad surface.

Base assembly 106 includes a rigid backing fixture or plate 150 and a detachable module 152 which is attached to the underside of backing plate 150. Backing plate 150 may be generally disk-shaped to match the configuration of substrate 10, and may be formed of a metal such as aluminum or stainless steel. Module 152 includes a rigid support fixture or cup 154, conformable layer 108, an annular shield ring 160, and an annular retaining ring 162. Each of these elements will be discussed in detail below.

Module 152 may be removably attached to backing plate 150 by various attachment mechanisms, such as bolts, screws, key and key slot combination, vacuum chucking, or magnets. As such, module 152 can be detached and replaced if it is damaged or worn out. In addition, it may be replaced to change the polishing parameters. For example, different modules may incorporate conformable layers with different durometer measurements. The different modules may also have different retaining ring widths or retaining ring heights. The height and width of the retaining ring affects the polishing rate near the edge of the substrate. These module features can be selected to provide an optimal polishing performance.

Cup 154 may be formed of aluminum or stainless steel and may have an outer lip or rim 156 which projects downwardly to surround a recess. The conformable layer 108 is disposed within the recess so that the bottom surface of the conformable layer is substantially flush with the bottom surface of rim 156. The recess may be approximately one-eighth to one-quarter inch deep.

The conformable layer 108 is made of a visco-elastic material that has a substantially homogeneous density. Conformable layer 108 is elastic; i.e., it will return to its original shape when an applied load is removed. Conformable layer 108 is slightly compressible. In addition, conformable layer 108 undergoes normal strain; i.e., it will redistribute its mass in directions normal to an applied load. The durometer measurement of the conformable layer must be carefully selected. If the durometer measurement is too low, the material will lack elasticity. On the other hand, if the durometer measurement is too high, the material will not undergo normal strain. Conformable layer 108 may have a durometer measurement of between approximately fifteen to twenty-five on the Shore scale. Preferably, conformable layer 108 has a durometer measurement of about twenty-one on the Shore scale. The conformable material may have an adhesive surface so that it adheres to the walls of cup 154. In addition, it should be resistant to heat and be chemically inert vis-a-vis the polishing process. An appropriate conformable material is a urethane material available from Pittsburgh Plastics of Zelienopal, Pa. Module 152 may be manufactured by pouring liquid urethane into cup 154 and curing it to form layer 109.

Referring to FIG. 5, conformable layer 108 permits substrate 10 to shift or pivot to accommodate changes in the surface of the polishing pad. Conformable layer 108 deforms to match the back side of substrate 10 and evenly distribute the load from loading mechanism 104 to the substrate. For example, if substrate 10 is warped, conformable layer 108 will, in effect, conform to the contours of the warped substrate.

A thin sheet 158 of a low-friction material may be laminated to the outer surface of conformable layer 108 to provide a low-friction substrate mounting surface 164. The sheet 158 may be a seven mil thick film of urethane having a durometer measurement of approximately eighty-three on the Shore scale. Sheet 158 permits the conformable material layer 108 to closely conform to the back side of substrate 10 but prevents the substrate from adhering to the conformable material. Sheet 158 is sufficiently thin that substrate 10 may be considered to be in direct contact with conformable layer 108.

Referring to FIG. 4A, module 152, as previously noted, also includes shield ring 160 and retaining ring 162. Shield ring 160 is formed of a rigid material such as aluminum or stainless steel and is positioned below comformable layer 108 to be substantially flush with the bottom surface of rim 156 and the conformable layer. Shield ring 160 holds conformable layer 108 with the recess of cup 154 when a load is applied to substrate 10. Shield ring 160 may be appropriately secured to rim 156 such as by screws or bolts (not shown).

Retaining ring 162 is an annular rigid ring, positioned within the circumference of shield ring 160. Retaining ring 162 may be adhesively attached directly to conformable layer 108. Retaining ring 162 may be formed of a hard plastic or ceramic material. Retaining ring 162 is separated from shield ring 160 by a small gap "r" so that the retaining ring may shift or pivot to accommodate variations in the vertical height of the surface of polishing pad 32. In operation, substrate 10 fits into a circular recess defined by retaining ring 162 and abuts mounting surface 164 of the conformable layer. Retaining ring 162 and substrate 10 have substantially the same thickness, so that retaining ring 162 also contacts polishing pad 32. The shear force created by the relative velocity between substrate 10 and polishing pad 32 tends to push the substrate from beneath carrier head 10. Retaining ring 162 prevents substrate 10 from moving from beneath base assembly 106.

Figure 4B:
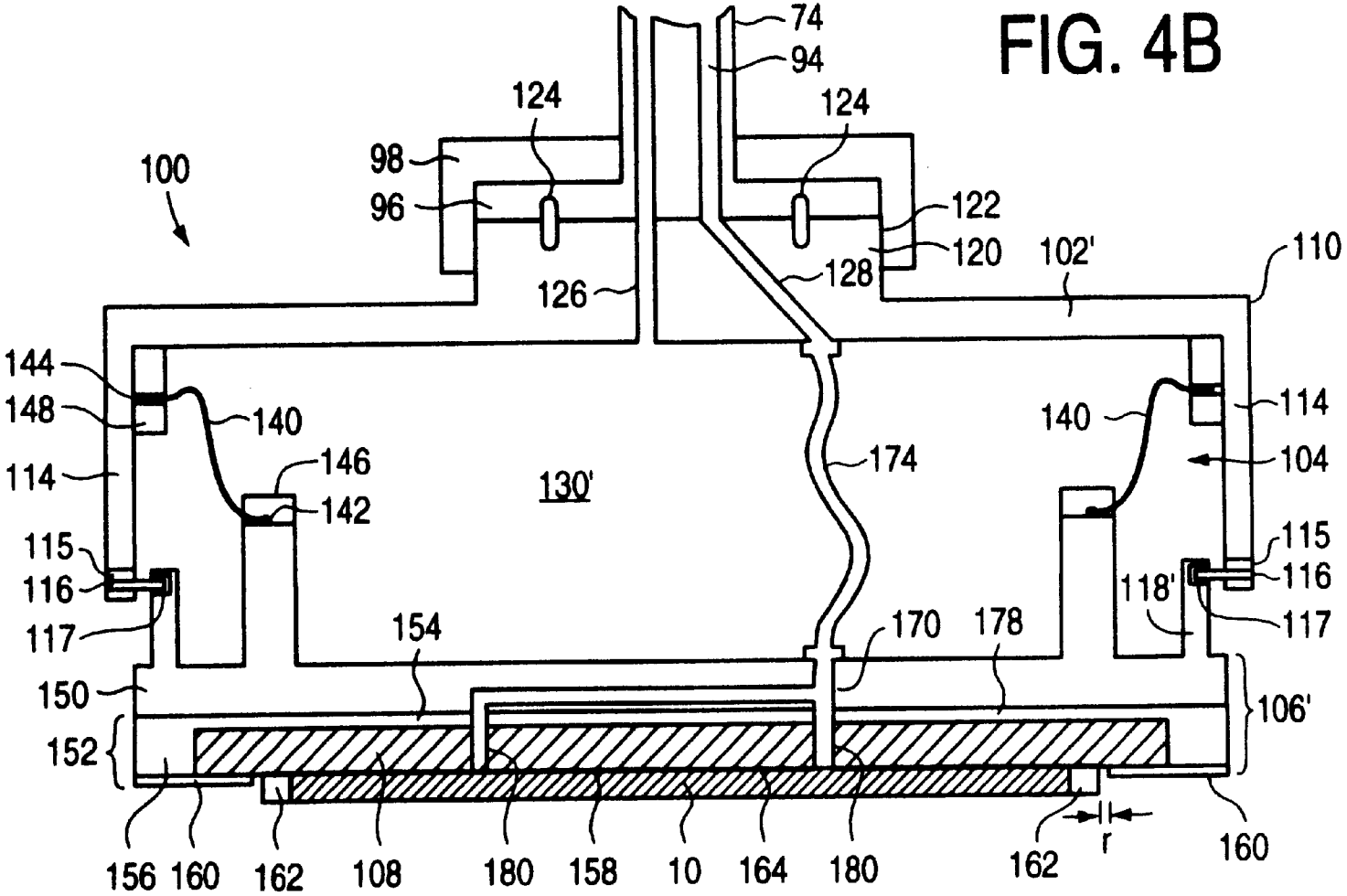
FIG. 4B is a view of the carrier head of FIG. 4A in which the bellows are replaced by a flexible membrane.

Referring to FIG. 4B, in another embodiment, in which similar parts are referred to with primed numbers, loading mechanism 104' may include a flexible membrane 140 instead of a bellows. Flexible membrane 140 may be an annular sheet of silicone approximately sixty mils thick, with inner and outer edges 142 and 144. The inner edge 142 is clamped between an inner clamp ring 146 and base assembly 106', whereas outer edge 144 is clamped between an outer clamp ring 148 and housing assembly 102'. The clamp rings attach the flexible membrane to the housing assembly and the base assembly to form pressure chamber 130'. Flexible membrane 140 acts as a diaphragm which rolls or unrolls, depending upon the vertical distance across pressure chamber 130'.

Housing assembly 102' includes two opposing flanges 114 which project downwardly from rim 110. Each flange 114 may have a rectangular slot 115. A torque pin 116 extends through each rectangular slot 115 and is secured in a receiving recess 117 in upward-extending wall portion 118' of backing plate 150 of base assembly 106'. The width of rectangular slot 115 is comparable to the width of torque pin 116 so that the pin cannot move horizontally in the slot. When drive shaft 74 rotates housing assembly 102', torque pins 116 transfer torque from the housing assembly to the base assembly. The height of rectangular slot 115 is greater than the height of torque pin 116 so that the pin can move vertically in the slot. Thus, base assembly 106' must rotate with housing assembly 102', but it is free to move vertically with respect to the housing assembly.

As discussed above, carrier head 100 may lift substrate 10 away from polishing pad 32 in order to move the substrate from one polishing station to another. In addition, the substrate may be ejected from carrier head 100 to return the substrate to transfer station 27 (see FIG. 1). Specifically, carrier head 100 may vacuum-chuck or pressure-eject the substrate to or from mounting surface 164, as explained in more detail below.

The carrier head includes several fluid lines which permit a gas, such as air, to flow into and out of base assembly 106 to vacuum-chuck or pressure-eject the substrate. Because base assembly 106 and housing assembly 102 can move vertically relative to each other, flexible fluid conduits are used to link conduit 128 to a passageway 170 in backing plate 150. As shown in FIG. 4A, the flexible fluid conduit may be a metal bellows 172. The metal bellows can expand and contract to match the distance across chamber 130. Alternately, as shown in FIG. 4B, the flexible fluid conduit may be a plastic tubing 174 positioned within chamber 130. The plastic tubing may, for example, be wrapped in a half, a three-quarter, a full turn. When base assembly 106 moves relative to the housing assembly, the tubing coils or uncoils to match the distance across chamber 130.

Figure 6A:
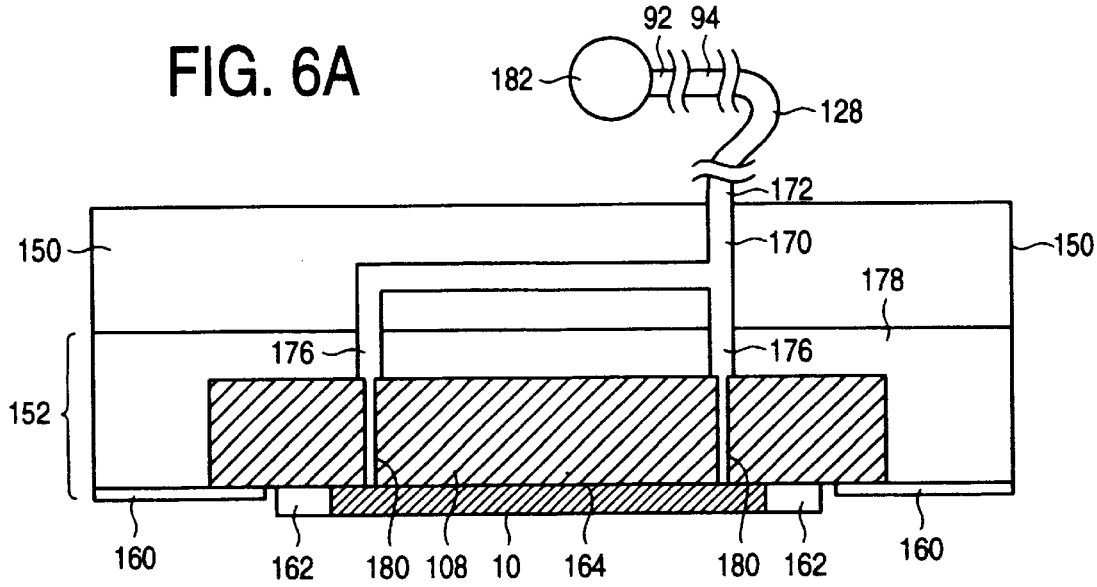
FIG. 6A is a schematic cross-sectional view of a carrier head according to the present invention illustrating vacuum chucking lines in the layer of conformable material.

Referring to FIG. 6A, in one implementation, passageway 170 is connected to one or more passages 176 of cup 154. In addition, vacuum-chucking passages 180 extend through conformable layer 108 from passages 176 in cup 154 to mounting surface 164. Each vacuum chucking passage 180 is simply a hole in the conformable layer. The hole is large enough so that it does not collapse when a vacuum is applied but small enough so that it does collapse when a load is applied to the substrate.

A pump 182 is connected via fluid line 921 channel 94, conduit 128, conduit 172, passageway 170, passages 176, and vacuum-chucking passages 180 to mounting surface 164. If a vacuum is applied to passages 180 by pump 182, substrate 10 will be vacuum-chucked to mounting surface 164. If air is forced into passages 180 by pump 182, substrate 10 will be ejected from mounting surface 164.

Figure 6B:
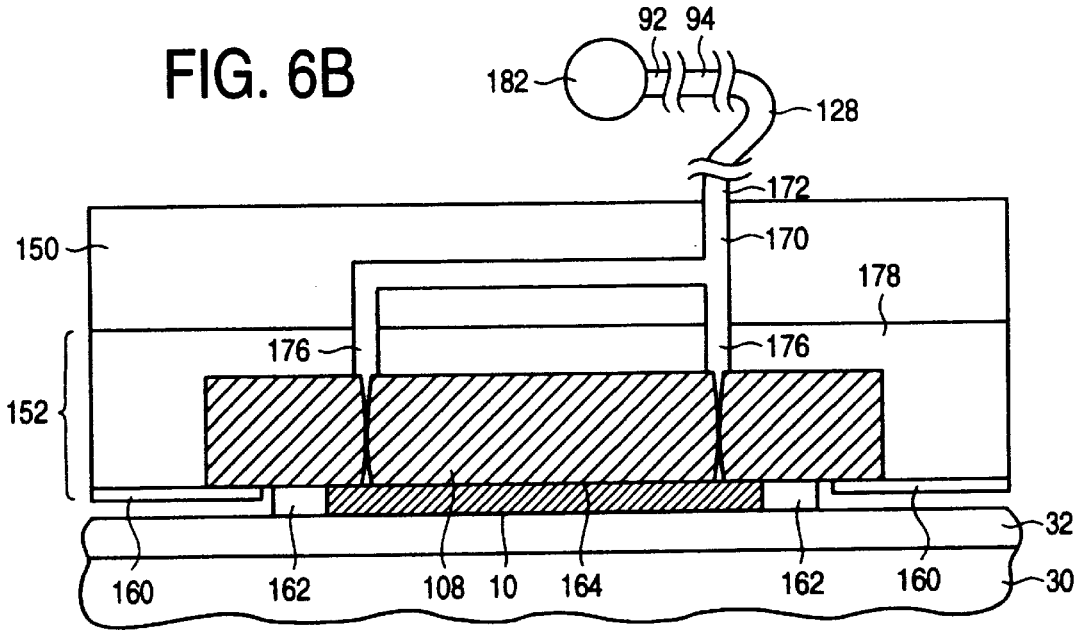
FIG. 6B is a view of the carrier head of FIG. 6A in which the vacuum chucking lines are closed by application of a load to the carrier head.

Referring to FIG. 6B, when substrate 10 is positioned against polishing pad 32 and a load is applied, conformable layer 108 will be compressed and vacuum-chucking passages 180 will collapse. Thus, the passages do not significantly affect the distribution of the load across the backside of the substrate. When the load is removed, conformable layer 108 will return to its normal state and vacuum-chucking passages 180 will reopen. Each vacuum-chucking passage 180 should be between approximately one-eighth and one-quarter of an inch in diameter.

Figure 7A:
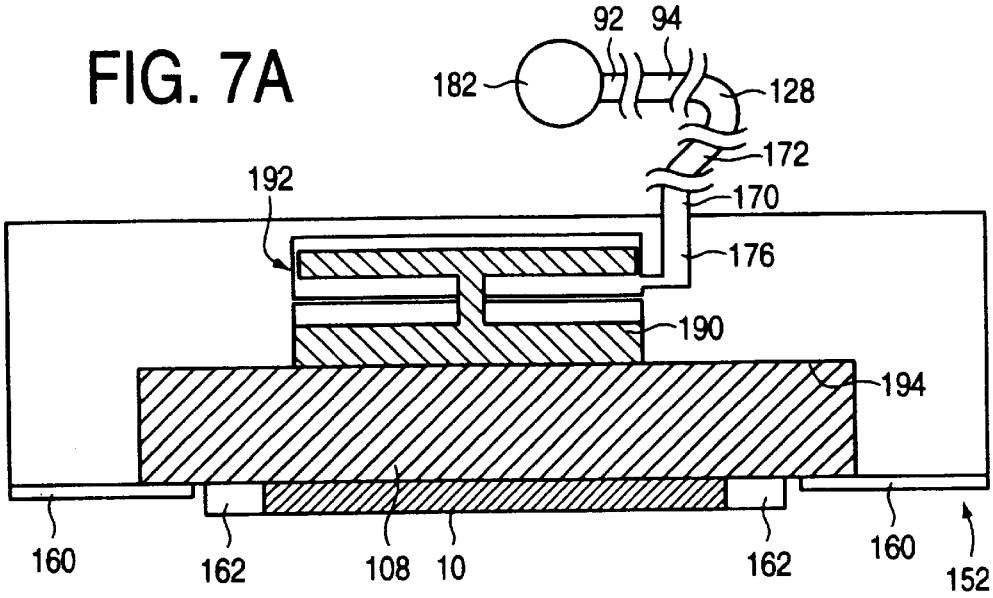
FIG. 7A is a schematic cross-sectional view of a carrier head according to the present invention incorporating a vertically-movable cylinder for forming a vacuum pocket.
Figure 7B:
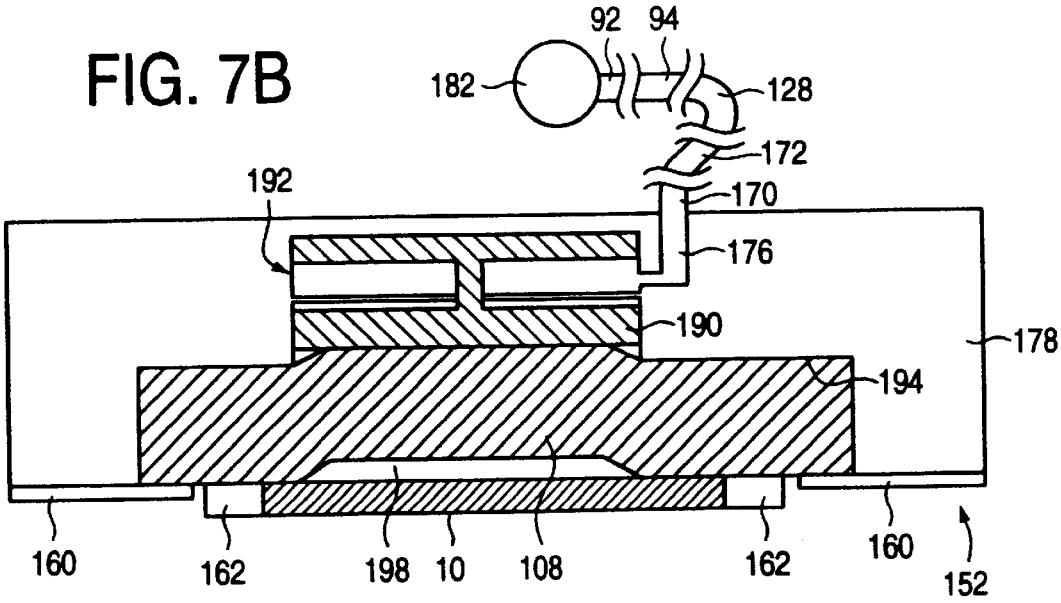
FIG. 7B is view of the carrier head of FIG. 7A in which the vertically-movable cylinder has been positioned to form a vacuum pocket.

Referring to FIGS. 7A and 7B, in another implementation, substrate 10 is vacuum-chucked to carrier head 100 by the formation of a vacuum pocket. As shown in FIG. 7A, module 152 may include a vertically-movable disk 190. Conformable layer 108 may be adhesively attached to disk 190. Disk 190 has a diameter less than that of the substrate, and it may be connected to the activating mechanism of an air cylinder 192. Air cylinder 192 may be positioned in cup portion 154, and it 192 may be powered by a pump 182. The pump is connected to the air cylinder by the flexible conduit, passageway 170, and passages 176. The actuating mechanism of air cylinder 192 may move disk 190 between a first position in which the disk is flush with a bottom surface 194 of base 178 of cup 154 (see FIG. 7A) and a second position in which the disk has been drawn upwardly away from the substrate. In the second position, the portion of conformable layer 108 beneath the disk will be pulled upwardly. Since the edges of conformable layer 108 remain in contact with substrate 10, whereas the center of conformable layer 108 is drawn away from the center of substrate 10, a vacuum pocket 198 is formed between the substrate and the conformable layer. This vacuum pocket vacuum-chucks the substrate to the carrier head.

A conformable layer in accordance with the present invention may be incorporated into various other carrier head designs, such as the one described in U.S. patent application Ser. No. 08/637,208 by Zuniga et al., filed on Apr. 24, 1996, entitled CARRIER HEAD DESIGN FOR A CHEMICAL MECHANICAL POLISHING APPARATUS, assigned to the assignee of the subject application, the entire disclosure of which is hereby incorporated by reference.

Figure 8:
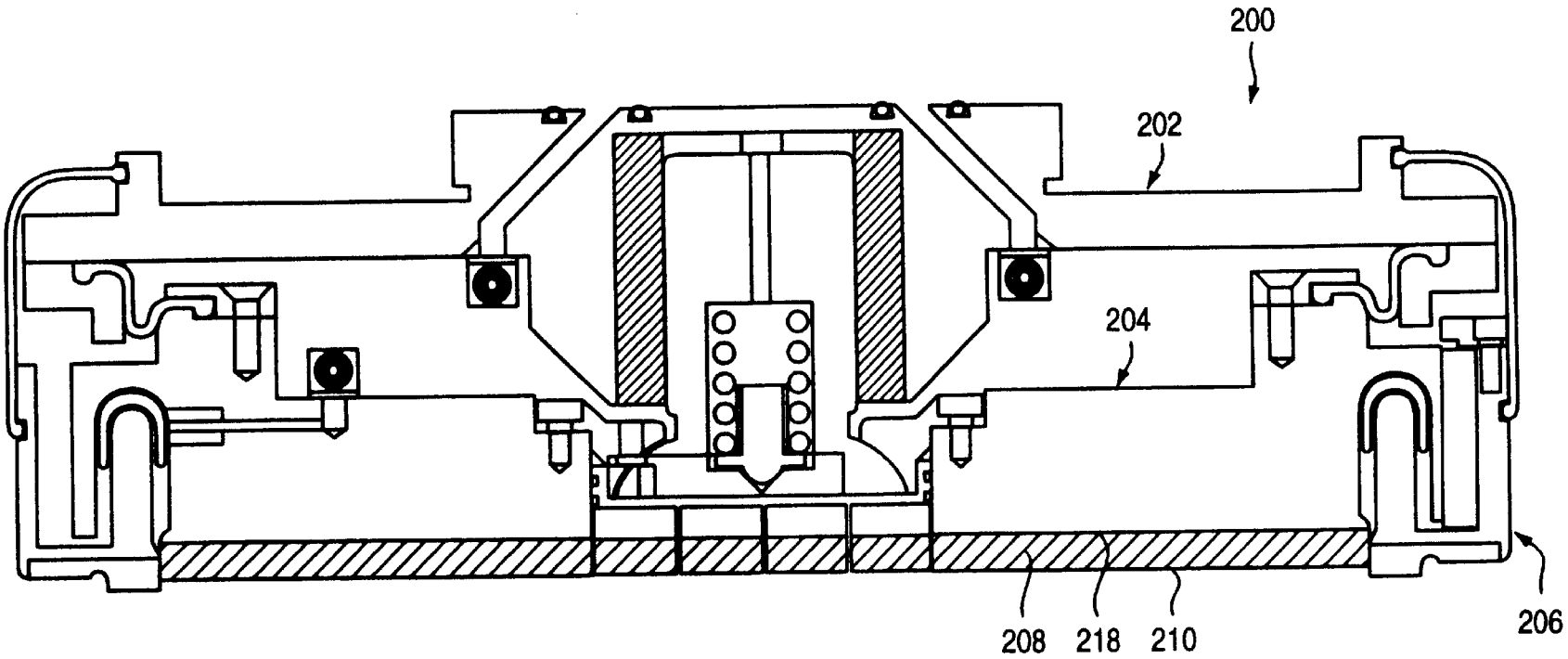
FIG. 8 is a schematic cross-section view of another embodiment of a carrier head according to the present invention.

Referring specifically to FIG. 8, such a carrier head 200 includes a housing assembly 202, a base assembly 204 and a retaining ring assembly 206. A conformable layer 208, similar in composition and structure to the conformable layer described above, may be adhered or attached to a surface 218 of base assembly 204 to provide a substrate mounting surface 210.

The present invention has been described in terms of a preferred embodiment. The invention however, is not limited to the embodiment depicted and described. Rather, the scope of the invention is defined by the appended claims.

What is claimed is:

1. A carrier head for a chemical mechanical polishing apparatus, comprising: a housing;

a rigid backing fixture movably connected to the housing by a flexible member, a volume between the housing and backing fixture providing a pressurizable chamber, the backing fixture having a surface located on a side of the flexible member opposite the chamber; and a module having a rigid support fixture detachably connected to and abbutting the surface of the backing fixture, the support fixture being detachable from the backing fixture and including a recess formed therein and a layer of conformable material disposed in the recess to provide a mounting surface for a substrate.

2. The carrier head of claim 1 wherein the module is mechanically connected to the backing fixture.

3. The carrier head of claim 1 wherein the module is magnetically connected to the backing fixture.

4. The carrier head of claim 1 wherein the backing fixture includes a rim surrounding the recess, and the conformable material fills the recess so that the mounting surface is flush with the rim.

* * * * *